US009876308B2

(12) United States Patent
Jones et al.

(10) Patent No.: US 9,876,308 B2
(45) Date of Patent: Jan. 23, 2018

(54) CONNECTOR PART FOR USE UNDER WATER

(71) Applicant: Siemens Aktiengesellschaft, Munich (DE)

(72) Inventors: Trevor Jones, Kendal (GB); Christopher Plant, Lancaster (GB)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/251,542

(22) Filed: Aug. 30, 2016

(65) Prior Publication Data

US 2017/0093082 A1 Mar. 30, 2017

(30) Foreign Application Priority Data

Sep. 24, 2015 (EP) ..... 15186691

(51) Int. Cl.
*H01R 13/523* (2006.01)
*H01R 13/453* (2006.01)
(Continued)

(52) U.S. Cl.
CPC ..... *H01R 13/523* (2013.01); *H01R 13/20* (2013.01); *H01R 13/4538* (2013.01);
(Continued)

(58) Field of Classification Search
CPC ..... H01R 13/523; H01R 13/4538; H01R 13/639; H01R 13/6205; H01R 13/631
(Continued)

(56) References Cited

U.S. PATENT DOCUMENTS 4,039,242 A * 8/1977 Wilson ..... H01R 13/523 439/188
4,174,875 A * 11/1979 Wilson ..... H01R 13/523 439/190

(Continued)

FOREIGN PATENT DOCUMENTS

EP 2854234 A1 4/2015
EP 2854235 A1 4/2015

OTHER PUBLICATIONS

EP Search Report, dated Mar. 29, 2016, for EP application No. 15186691.0.

*Primary Examiner* — Renee Luebke
*Assistant Examiner* — Paul Baillargeon
(74) *Attorney, Agent, or Firm* — Beusse Wolter Sanks & Maire

(57) ABSTRACT

A connector part which is a female connector part for engagement with a male connector part having a pin. A connector body has a front portion with an opening for receiving a pin of a male connector part. A chamber inside the connector body is filled with dielectric liquid. A shuttle pin is configured to seal the opening in the front portion of the connector body when the connector part is in a de-mated state. The shuttle pin is moveable rearwardly into a rear portion of the connector body during mating. The first latching mechanism latches the shuttle pin to the pin of the male connector part during mating. A second latching mechanism in the rear portion of the connector body inside a fluid-filled chamber latches at least one of the shuttle pin or the pin towards the connector body in a mated state.

16 Claims, 4 Drawing Sheets

(51) Int. Cl.
*H01R 13/62* (2006.01)
*H01R 13/631* (2006.01)
*H01R 13/639* (2006.01)
*H01R 13/20* (2006.01)

(52) U.S. Cl.
CPC ..... *H01R 13/6205* (2013.01); *H01R 13/631* (2013.01); *H01R 13/639* (2013.01)

(58) Field of Classification Search
USPC ..... 439/199, 207; 24/DIG. 60; 166/242.7, 166/125, 381
See application file for complete search history.

(56) References Cited

U.S. PATENT DOCUMENTS 4,242,778 A 1/1981 Kay
9,287,658 B2 * 3/2016 Lewin ..... H01R 13/523

* cited by examiner

CONNECTOR PART FOR USE UNDER WATER

CROSS REFERENCE TO RELATED APPLICATIONS

This application claims the benefit of European Application No. EP15186691 filed 24 Sep. 2015, incorporated by reference herein in its entirety.

FIELD OF THE INVENTION

The present invention relates to a connector part for use under water or in a wet or severe environment. In particular, the application relates to dummy plugs and protective caps for subsea use.

BACKGROUND

Several applications are known in which connections need to be provided under water, such as electrical connections and/or optical connections. Examples include a subsea installation for the production of hydrocarbons from a subsea well, in which different components of the subsea installation may need to be connected for power transfer and/or data communication. Such connections may for example comprise a connection from a topside installation, such as a floating or fixed platform or from an on-shore site to a subsea component, for example by means of an umbilical or a subsea cable. Other connections include electrical connections between different type of subsea equipment, such as a connection between a subsea transformer and subsea switchgear for the transfer of electrical power.

Subsea production equipment, such as pumps or compressors, may have a significant power consumption and may accordingly require the use of high voltage electric power connections. For a three-phase electrical connection, three high voltage subsea wet-mateable connectors may be required and may need to be mated subsea. In a typical application, the subsea connector halves are mounted to respective stabplates, and three or more electrical connections may be established by bringing the two stab plates into engagement. Since in such arrangements, the mating forces of three or more subsea wet-mateable connectors need to be overcome simultaneously, a total mating force of the two stabplates of significant magnitude needs to be applied during mating. It is generally difficult to apply these high mating forces by means of a remotely operated vehicle (ROV).

To reduce the mating force of the respective connectors, the documents EP 2 854 234 A1 and EP 2 854 235 A1 disclose latching mechanisms between a shuttle pin of a female connector part and a pin of a male connector part by means of which the mating force between the two connector parts can be reduced. By making use of these configurations, it becomes possible to simultaneously mate plural high voltage wet-mateable connectors in stabplate assemblies by means of an ROV. The two stabplates usually comprise a locking mechanism that locks the stabplates together and thus holds the connector halves in the mated state. Consequently, the subsea wet-mateable connectors generally do not comprise any locking mechanism themselves, since they are locked together by the stab plate assembly.

When installing components of a subsea installation, there are often only specific time slots when the weather conditions are such that the subsea equipment can be installed by means of a floating vessel. It is often the case that one component is installed, whereafter the weather conditions change so that the vessel has to return to shore. A significant amount of time can pass before the next component is installed. The same problems occur when components are being exchanged or serviced. In this respect, it is problematic that high voltage subsea wet-mateable connectors can only be exposed to the seawater environment in an unmated state for a certain period of time, for example 30 or 60 days, that accumulates over the lifetime of the connector. For the above outlined reasons, it regularly occurs that unmated connectors are deployed subsea and that a significant amount of time passes before the connector parts are connected to complementary connector parts of another component of the subsea installation. For protecting the subsea deployed connectors from the subsea environment, so called dummy plugs may be used, which are essentially complete wet-mateable connectors without any cable connection that serve the main purpose of protecting the complementary connector half.

As described above, in applications where the connectors are mated by means of a stabplate mating mechanism, the connectors do themselves not comprise any locking features for locking the two connector halves together, so that the use of stand-alone dummy plugs is not possible. Providing a complementary stabplate with plural dummy plugs allows the protection of the subsea deployed wet-mateable connectors, yet the cost of providing such configuration for the purpose of protection are prohibitive.

From conventional wet-mateable connectors where single connector halves are mated by means of an ROV, it is known to use an external latching mechanism that latches the two connector halves together. The use of such external latching mechanism in the above outlined stab plate configurations is generally not desirable, since these mechanisms are prone to marine growth, and they may cause the connector halves to be become locked in the mated state. Furthermore, this would require a modification of the high voltage wet-mate connectors which increases costs and adds complexity to the connectors which may lead to an additional failure mechanism.

It is thus desirable to provide cost efficient protection of subsea wet-mateable connectors, in particular connectors that are mated by use of a stabplate mating mechanism. Furthermore, it is desirable to not further increase the complexity of the subsea wet-mate connectors. Also, it is desirable to improve the mating and de-mating of the wet-mateable connectors in such stabplate mating mechanism. It is desirable to efficiently protect subsea deployed wet-mateable connector parts against the negative effects of seawater exposure in a cost efficient way.

SUMMARY

Accordingly, there is a need for mitigating at least some of the drawbacks mentioned above and for providing an improved subsea wet-mateable connector part.

This need is met by the features of the independent claims. The dependent claims describe embodiments of the invention.

According to an embodiment of the invention, a connector part for use underwater or in a wet or severe environment is provided, wherein the connector part is a female connector part configured for engagement with a complementary male connector part having a pin. The (female) connector part comprises a connector body having a front portion with an opening for receiving the pin of the male connector part and a chamber inside the connector body. The chamber is filled with a medium, in particular with dielectric liquid. The connector part further includes a shuttle pin configured to seal the opening in the front portion of the connector part when the connector part is in a de-mated state. The shuttle pin is configured to be moveable rearwardly into a rear portion of the connector body during the mating of the connector part with the male connector part. Interaction with the pin of the male connector part may for example urge the shuttle pin rearwardly into the connector body during mating of the male and female connector parts.

The connector further comprises a first latching mechanism configured to latch the shuttle pin to the pin of the male connector part during mating. It further comprises a second latching mechanism arranged in the rear portion of the connector body inside a fluid filled chamber (which can be the same as the above-mentioned chamber or a different chamber) and configured to latch at least one of the shuttle pin or the pin to the connector body in a mated state of the connector part and the male connector part in order to hold the connector part and the male connector part in the mated state. It further includes a retaining element configured to retain the shuttle pin in the connector body when the latching between the shuttle pin and the pin is released during de-mating of the connector part and the male connector part.

By means of the second latching mechanism, it may thus be possible to attach the connector part to the male connector part without the need to modify the male connector part. Furthermore, since the second latching mechanism is arranged inside the connector body in the fluid filled chamber, it may not have any parts that are exposed to the subsea environment at least when the connector part is in the mated state. Furthermore, the mating of the connector part with the male connector part and the securing of the connector part to the male connector part can be performed with a single ROV operation, for example by pushing the connector part onto the male connector part. This is beneficial since an ROV can generally only perform a single operation at a time, so that when the securing of the connector part to the male connector part would require a second ROV operation, the connector part may already become de-mated from the male connector part before such second ROV operation can be carried out.

Furthermore, when the connector part and the male connector part are used in a stabplate mating mechanism, the connector halves generally do not have any additional locking features as outlined above. Such stabplate mating mechanism furthermore only holds the stabplates together, whereas the connector halves are usually spring mounted to the stabplates. By providing the second latching mechanism in the connector part when used in such stab plate mating mechanism, a more reliable mating and de-mating of the connector part with the male connector part may be achieved, since the connector parts are locked together internally by the second latching mechanism. Protection against unintended de-mating of the female and male connector parts may thus be improved.

It should be clear that the latching of the pin or shuttle pin to the connector body by means of the second latching mechanism does not need to be a direct latching onto a housing of the connector body. It is sufficient if the component to which the pin and/or shuttle pin is latched is attached to such housing so that engagement of the second latching mechanism fixes the position of the pin and shuttle pin relative to the connector body.

In an embodiment, the latching of the first latching mechanism is releasable by a first releasing force, and the latching of the second latching mechanism is releasable by a second releasing force. The first releasing force may be larger than the second releasing force. The releasing force may for example be provided by a pulling force when pulling the female connector part apart from the male connector part or vice versa. In such configuration, it can be ensured that the first latching mechanism is not released during the de-mating of the female connector part from the male connector part before the shuttle pin is released from the second latching mechanism and returned to its position in which it seals the opening in the front portion of the connector body.

The first latching mechanism may be a magnetic latching mechanism that provides magnetic latching between the shuttle pin and the pin. Such magnetic latching mechanism may for example comprise one or more permanent magnets in a front portion of the pin and/or of the shuttle pin. In particular, the first latching mechanism may be configured as described in the document EP 2 854 234 A1, the contents of which is incorporated herein by reference in its entirety. The magnetic structure for latching the pin to the shuttle pin may either be included in the pin or in the shuttle pin, and an insert of material having a high magnetic permeability may be provided in the other of the pin or the shuttle pin. The material of high permeability may for example be a nickel or cobalt iron alloy, such as SUPRA 50, INVAR, or Vaco-Flux 9 CR.

In another embodiment, the first latching mechanism may be a mechanical latching mechanism providing mechanical latching between the shuttle pin and the pin. In particular, the latching mechanism as described in the document EP 2 854 235 A1 may be used, the contents of which is incorporated herein by reference in its entirety.

The second latching mechanism may be a magnetic latching mechanism that provides magnetic latching between the connector body and the shuttle pin or pin. Magnetic latching or mechanical latching provide a reliable latching over a large number of cycles and can furthermore be provided compact and cost efficiently in rear portion of the connector body.

The second latching mechanism may comprise a first latching element that is mechanically supported against the connector body and a second latching element that is provided in or fixedly coupled to the shuttle pin. When the second latching mechanism is engaged, the shuttle pin can thus be held firmly at a fixed position inside the connector body.

As an example, the first latching element, the second latching element or both may comprise a permanent magnet. One of the first or second latching elements may comprise an insert of high permeability material that interacts with the permanent magnet of the respective other latching element. Permanent magnets may for example be mounted to or supported against the connector body, and the shuttle pin may comprise an insert of high permeability material in a rear portion thereof. In other embodiments, for example in which the shuttle pin employs permanent magnets or high permeability material in a front portion thereof for providing the first latching mechanism, such permanent magnets or high permeability material may also be used as part of the second latching mechanism and may accordingly interact with the first latching element that is mechanically supported against the connector body.

In some embodiments, for example when the connector part is a fully functional connector part or is a dummy plug, the connector part may further comprise an insulating sleeve that may be arranged inside the connector body. In the mated state of the connector part when the second latching mechanism is engaged, the insulating sleeve may at least partly be located between the first latching element and the second latching element. In particular when providing magnetic latching, the shuttle pin can be held by the second latching mechanism in the rear part of the connector body even when such insulating sleeve is provided. Such insulating sleeve may provide electric shielding. As an example, it may have a conductive layer provided on the outside of the insulating layer that is earthed for providing an earth screen, and/or it may comprise an inner conductive layer that is provided on an inner surface of the insulating sleeve and that is in electrical contact with an electric contact portion of the pin of the male connector part in the mated state, so that electrical stresses in a space between the insulating sleeve and the pin are avoided since the conductive layer is on the same potential as the contact portion (or electrical contact) of the pin. The latching in the rear portion of the connector part may thus be provided in configurations in which the connector part is fully functional, for example in which it is a dummy plug that allows electrical testing of the connector part.

Such insulating sleeve may for example be cup-shaped and may partly surround the shuttle pin in the mated state of the connector part, i.e. the shuttle pin may be located inside such cup shape.

In another embodiment, one of the first or second latching elements may comprise a latch and the other of the first or second latching elements may comprise a recess or groove. A relatively simple and secure latching may thus be achieved. It should be clear that magnetic latching and mechanical latching may also be used in combination.

In an embodiment, the retaining element is provided by a third latching mechanism that is configured to provide latching between the connector body and the shuttle pin in the de-mated state of the connector part. The third latching mechanism may be a magnetic or mechanical latching mechanism. The latching mechanism may be configured such that the shuttle pin cannot be released so as to exit the opening in the connector body and leave the connector body, or the respective releasing force may at least be significantly larger than the releasing force of the first latching mechanism. In another embodiment, the retaining element may be provided by a protrusion on the shuttle pin that is caught on a retaining structure in the connector body so as to retain the shuttle pin in the connector body. When the protrusion is caught on the retaining structure during de-mating, the first latching mechanism is released and the shuttle pin is prevented from leaving the connector body.

Note that the second and third latching mechanisms may use the same latching element on the shuttle pin.

In an embodiment, the connector part may further comprise a locking mechanism that is configured to be engaged at least after the connector part is mated to the male connector part and after engagement of the second latching mechanism. The locking mechanism locks the connector part to the male connector part. As outlined above, the release force of the second latching mechanism may be limited, so that by providing an additional locking mechanism, the connector part can be securely attached to the male connector part. This may allow the mated connector to resist vibration and other loading which the connector may experience during operation or deployment. The locking mechanism may be configured to be operable separately from the second latching mechanism. In particular, it may be configured to be operable by a separate ROV operation. In such configuration, the ROV can thus mate the female connector part with the male connector part, thereby engaging the second latching mechanism and holding the female connector part in place, whereafter the ROV can with a second operation engage the additional locking mechanism. The female connector part and the male connector part may thus be mated and firmly secured together by two ROV operations.

The locking mechanism may be an external locking mechanism. In particular, it may have components that are exposed to seawater when the connector part is deployed subsea and the locking mechanism is in the locked state. The male connector part may for example comprise a receptacle in which the pin is located, and the locking mechanism may comprise a collar made of plastic material and including plastic teeth that is pushed over the connector part, wherein the plastic teeth engage a receptacle of the male connector part to hold the connector part and the male connector part firmly together. Other embodiments of the locking mechanism are certainly conceivable, such as an external latching mechanism, although it is preferred that the locking mechanism does not require any modification of the male connector part.

The connector part may be a dummy plug or may be a protective cap configured to be connected to the male connector part for providing protection for the male connector part when the male connector part is deployed subsea (but not connected to a fully operable female connector part). A dummy plug or protective cap having such configuration may be produced cost efficiently and can furthermore be mated with the male connector part without requiring modification thereof, even if the male connector part does not have any locking features.

In particular, the connector part may not be mounted to the end of a cable or of an oil-filled hose. A dummy plug or a protective cap does generally not require any electrical connection thereto.

The connector part may not comprise any electrical or optical contact that is connected to a power line or data line so that the mating of the connector part with the male connector part does not establish an electrical connection and does not establish a data connection through the connected female and male connector parts. The connector part may thus be simplified significantly compared to the fully functional female connector part, so that it can be produced cost efficiently.

As a further example, the connector part may only comprise a single seal sealing between the shuttle pin and the connector body. Such single seal may be sufficient for the purpose of providing protection, and the cost of the connector part as well as its complexity may be further reduced.

According to a further embodiment of the invention as illustrated in FIG. 7, a stabplate assembly 300 is provided comprising one or more connector parts 100 having any of the above outlined configurations. The connector parts 100 are mounted to a stabplate 310. By means of such stabplate assembly 300, the connector parts 100 provided in the stabplate assembly 300 can be mated with increased reliability, and advantages similar to the ones outlined further above may be achieved.

It is to be understood that the features mentioned above and those yet to be explained below can be used not only in the respective combinations indicated, but also in other combinations or in isolation without leaving the scope of the present invention.

BRIEF DESCRIPTION OF THE DRAWINGS

The foregoing at other features and advantages of the invention will become further apparent from the following detailed description read in conjunction with the accompanying drawings. In the drawings, like reference numerals refer to like elements.

DETAILED DESCRIPTION

Figure 1:
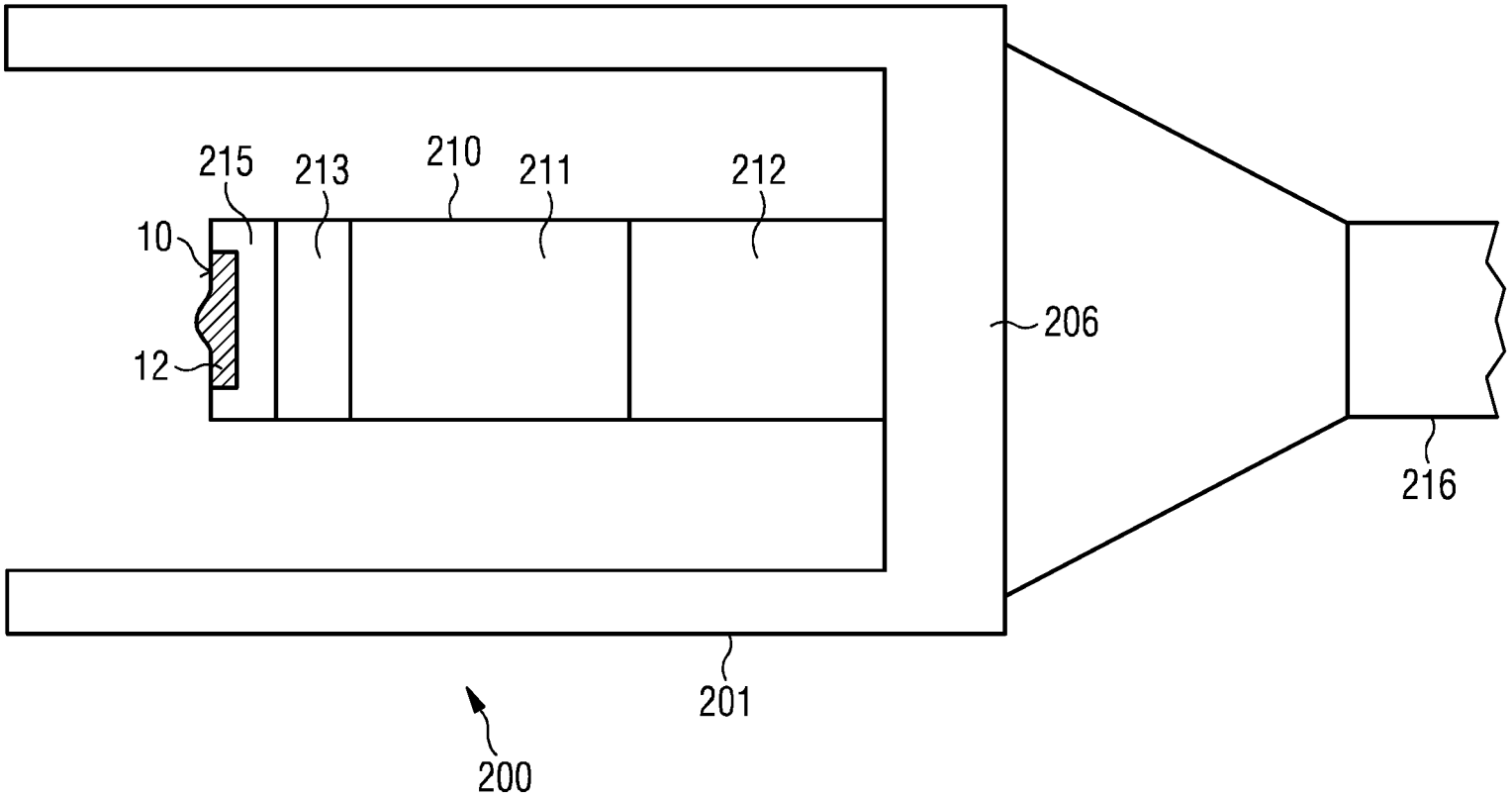
FIG. 1 is a schematic drawing showing a sectional side view of a male connector part of a subsea wet-mateable connector.

In the following, embodiments illustrated in the accompanying drawings are described in more detail. It should be clear that the following description is only illustrative and non-restrictive. The drawings are schematic representations only, and elements in the drawings are not necessarily to scale with each other.

FIG. 1 illustrates a male connector part 200 of a subsea wet-mateable connector. The male connector part 200 includes a pin 210 that has an insulating sleeve 211 that surrounds a conductor (not shown). The conductor is electrically connected to the electrical contact 213, which can be provided in form of a contact band or ring in a forward portion or tip of the pin 210. The rear part of pin 210 is furthermore provided with a metalized coating 212. The pin 210 projects forwardly from a support 206. The male connector part 200 furthermore has a receptacle 201 in which a respective female connector part is received. From the rear part of the male connector 200, a cable 216 may extend that provides a connection, in particular an electrical connection to the electrical contact 213. The tip 215 of the pin 210 includes a second latching element 12 of a latching mechanism 10, which is herein called the first latching mechanism.

As can be seen, when the male connector part 200 is deployed subsea, water enters the receptacle 201 and gets into contact with the electrical contact 213. Due to marine growth and corrosion, such male connector part 200 can be exposed to the subsea environment only for a limited number of days.

Figure 2:
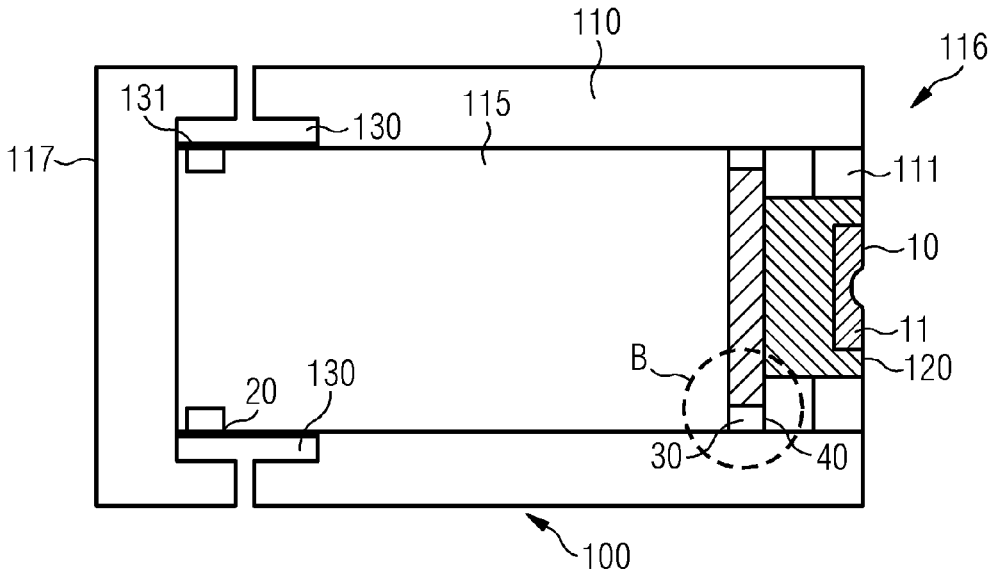
FIG. 2 is a schematic drawing showing a sectional side view of a female connector part according to an embodiment of the invention.

FIG. 2 illustrates a female connector part according to an embodiment. The female connector part 100 comprises a connector body 110 in which a chamber 115 is provided that is filled with a medium, in particular with a dielectric liquid. In a front portion 116, the connector body 110 has an opening. To close the opening, a shuttle pin 120 is provided and is sealed by means of the seal 111 to the connector body 110. Seal 111 may for example be a wiper seal. Seal 111 may for example be a combination of sealing elements, and may typically comprise at least one rod seal and one wiper seal.

The shuttle pin 120 is allowed to travel rearwardly inside the connector body 110, i.e. towards the rear portion 117 of the female connector part 100. As an example, during mating, the pin 210 of the male connector part 200 as illustrated in FIG. 1 engages the shuttle pin 120 and pushes the shuttle pin 120 rearwardly into the connector body 110, whereby the sealing by means of seal 111 passes from the shuttle pin 120 to the pin 210. Shuttle pin 120 and pin 210 may accordingly have substantially the same outer diameter.

When the shuttle pin 120 travels rearwardly, and pin 210 enters the connector body 110, fluid filling the chamber 115 is displaced. For accommodating this displaced fluid, compensators 130 are provided. Compensators 130 include a chamber that is in flow connection with the surrounding seawater and furthermore comprise a flexible element 131, such as a membrane, that is deformed to take up the displaced volume. In the example of FIG. 2, the membrane 131 would be deflected to increase the volume of chamber 115 and would urge seawater out of the chamber of compensator 130. It should be noted that compensator 130 is not drawn to scale in the figures, and that the compensation capability of the compensator 130 is adapted to the displaced volume that needs to be accommodated.

To hold the shuttle pin 120 in the state illustrated in FIG. 2 while it seals the opening in the connector body 110 in an unmated state of the female connector part 100, a retaining element 40 is provided. There are several possibilities of implementing the retaining element 40. One possibility is a mechanical latching mechanism 30, as for example illustrated in FIG. 5, a magnetic latching mechanism 50, as for example illustrated in FIG. 4, or simply a protrusion on the shuttle pin 120 that bears against a shoulder that is mechanically connected to the connector body 110. In the latter case, a spring may be provided inside the chamber 115 to urge the shuttle pin 120 forwardly and to urge the protruding portion against such shoulder, thereby holding the shuttle pin 120 in the closed position in which it closes the opening in the connector body. It should be clear that such spring may also be provided in combination with a latching mechanism.

The female connector part 100 comprises a first latching mechanism 10 having a first latching element 11. The first latching element 11 interacts with the second latching element 12 provided in the male connector part 200 to latch together the pin 210 and the shuttle pin 120. Such latching may be provided magnetically. In particular, the latching mechanism described in the document EP 2 854 234 A1 may be used. In other embodiments, the latching may be mechanically, and the mechanical latching described in the document EP 2 854 235 A1 may be used.

By latching together the pin 210 and the shuttle pin 120, no spring has to be used to urge the shuttle pin 120 forwardly, or a spring having a relatively low spring force may be used. This is due to the fact that when de-mating the connector parts, the pin 210 is latched to the shuttle pin 120 and thus pulls the shuttle pin 120 towards the forward portion 116 of the female connector part 100, until the shuttle pin 120 is retained by the retaining element 40, in which position the opening in the connector body 110 is sealed by the shuttle pin 120 and the latching by the first latching mechanism 10 is released through to the pulling force.

Figure 3:
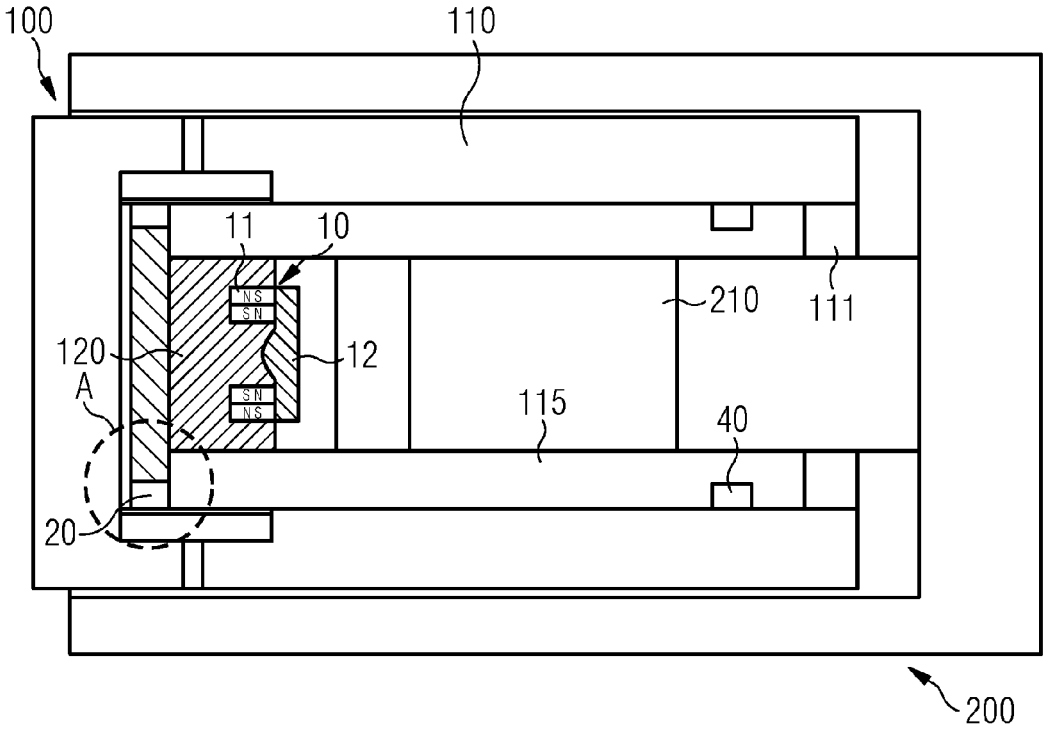
FIG. 3 is a schematic drawing showing a sectional side view of the male connector part of FIG. 1 and the female connector part of FIG. 2 in the mated state.

FIG. 3 illustrates the male connector part 200 and the female connector part 100 in a mated state. As an example only, the first latching mechanism is illustrated as including permanent magnets as the first latching element 11, and an insert of high permeability material as the second latching element 12. As can be seen in FIG. 3, the pin 210 has urged the shuttle pin 120 rearwardly inside the connector body 110, and the seal 111 is in engagement with the pin 210 to seal the chamber 115. The female connector part 100 includes a second latching mechanism 20 that is disposed in the rear portion 117 of the female connector part 100. In the present embodiment, the second latching mechanism 20 is configured to provide latching between the connector body 110 (or at least a part that is mechanically supported against the connector body 110) and the shuttle pin 120. Upon engagement of the second latching mechanism 20, the shuttle pin 120 is thus held in the rear portion of the female connector part 100. Since by means of the first latching mechanism 10, the pin 210 is latched to the shuttle pin 120, the pin 210 is also prevented from leaving the chamber 115 so that the male and female connector parts 200, 100 are held in the mated state.

Figure 6:
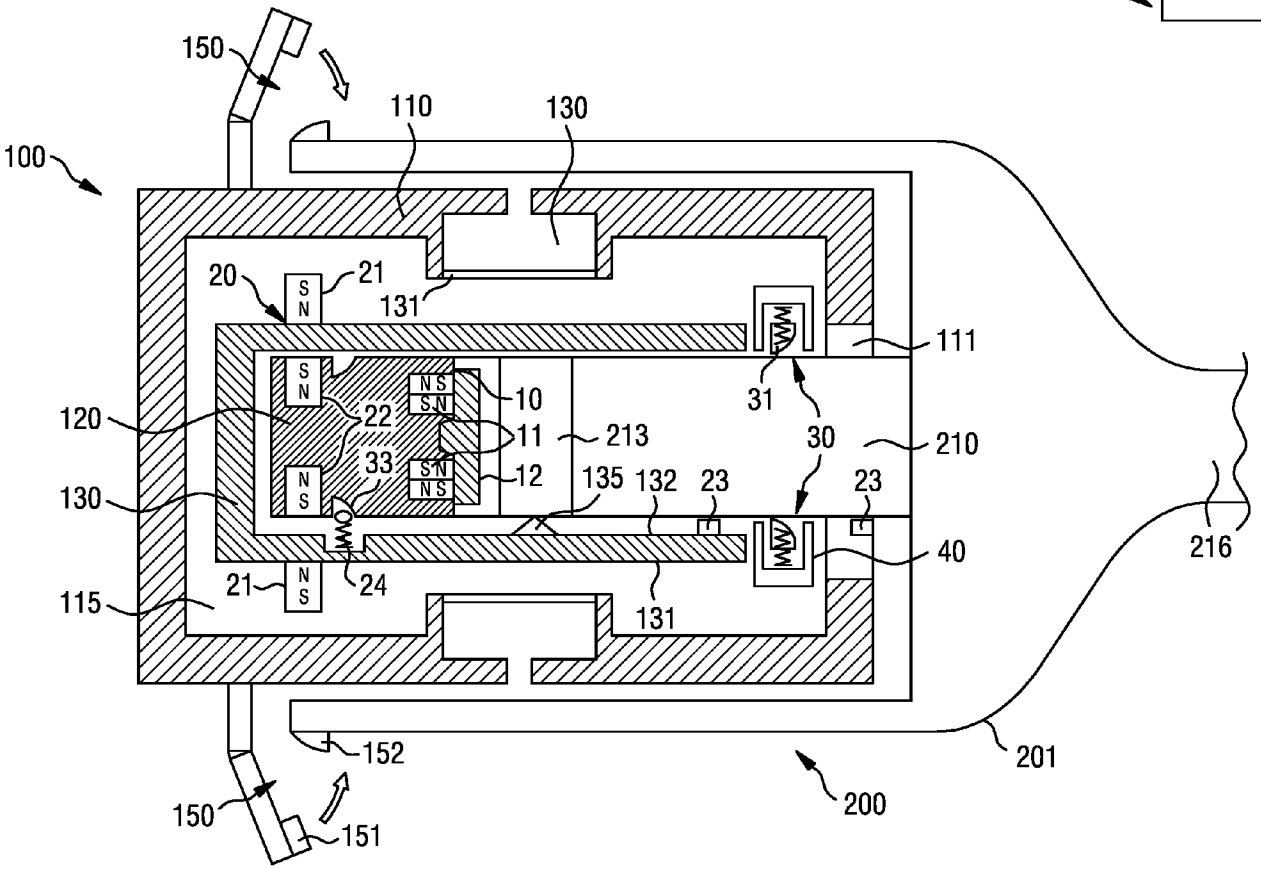
FIG. 6 is a schematic drawing showing a sectional side view of a female connector part according to a further embodiment in a mated state with a male connector part.

Note that in other embodiments, the second latching mechanism may latch to the pin 210, as schematically illustrated by second latching mechanisms 23 in FIG. 6, or may latch to the first or second latching elements 11, 12 of the first latching mechanism, e.g. magnetically, or may latch to a latching element of a third latching mechanism forming part of retaining element 40.

Accordingly, if the female connector part 100 is for example a dummy plug or a protective cap, a remotely operated vehicle (ROV) can grab the female connector part 100 and mate it with the male connector part 200, and thereafter release the female connector part 100 without the risk that the two connector parts become de-mated again. The two connector parts can then remain secured to each other in the mated state by means of the second latching mechanism 20 and the first latching mechanism 10, or the ROV may in a separate operation engage an additional locking mechanism to lock the two connector parts together. In particular, it is not required to mount the female connector part 100 to a stabplate assembly to provide secure engagement between the male and female connector parts 200, 100. Plural male connector parts 200 that are mounted in a stabplate assembly can each be protected by individual female connector parts 100 in the form of dummy plugs or protective caps, without the risk of unintentional de-mating.

For removing the female connector part 100 from the male connector part 200, the pulling force is applied to one of the connector parts. In order to ensure that the second latching mechanism 20 is released prior to the release of the first latching mechanism 10, so that the shuttle pin 120 is pulled back towards the position illustrated in FIG. 2, the releasing force of the first latching mechanism 10 is set to be higher than the releasing force of the second latching mechanism 20. Accordingly, when the pulling force is applied, the second latching mechanism 20 is released, thus pulling the shuttle pin 120 into sealing engagement with the seal 111. As can be seen, no spring is required to bring the shuttle pin 120 back into its original position. When pulling continuous, the shuttle pin 120 is retained by the retaining element 40, and the latching between the pin 210 and the shuttle pin 120 is finally released.

It is noted that the forward part or portion of the respective connector part is considered to be the part which faces the complementary other connector part. In other words, the forward portion or forward part of the male connector part 200 is the part at which the pin tip 215 is located, whereas in the female connector part 100, the forward portion is the portion where the shuttle pin 120 closes the opening in the unmated state of the connector part.

In some embodiments, the female connector part 100 may be a protective cap. Such protective cap would hardly require any additional components. In particular, it may not comprise any plated plastic insulators or plated moldings around the pin 210 in the mated state, it may not comprise any electrical contact, such as a socket contact for contacting the electrical contact 213 of the pin 210, and it may only be provided with a single barrier, in particular a single seal 111 against the surrounding seawater. Accordingly, such protective cap can be manufactured cost efficiently and has a reduced complexity.

Figure 4:
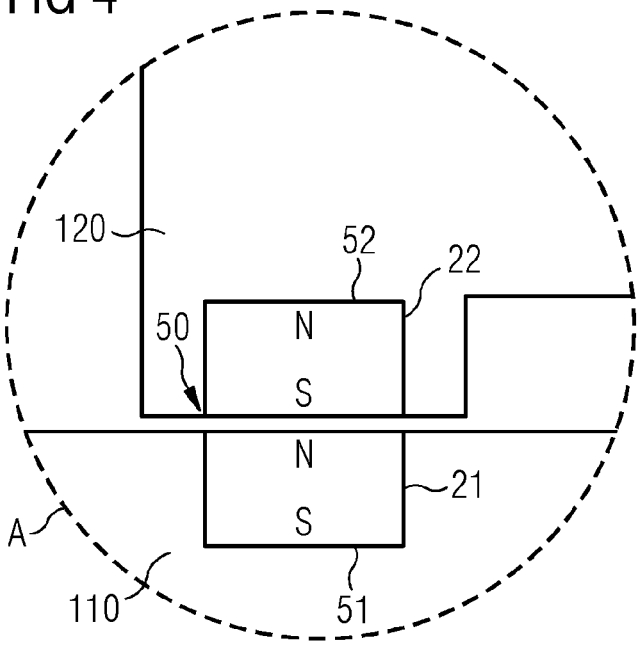
FIG. 4 is a schematic drawing showing an implementation of a latching mechanism according to an embodiment.

FIG. 4 is an enlarged view of the area A of FIG. 3 and illustrates a possible implementation of the second latching mechanism 20. The second latching mechanism 20 is implemented as a magnetic latching mechanism 50. It may for example comprise a first latching element 21 in form of a permanent magnet 51 that is supported in the connector body 110. It may further comprise a second latching element 22 in form of a second permanent magnet 52 that is supported in the shuttle pin 120. The permanent magnets 51, 52 are oriented such that in the mated state as illustrated in FIG. 3, magnetic poles of opposite polarity face each other, thereby providing an attractive magnetic force between the two permanent magnets 51, 52. Accordingly, the shuttle pin 120 is held in the position by the magnetic force applied by the magnetic latching mechanism 50. It should be clear that other configurations are also conceivable. As an example, either one of the permanent magnets 51, 52 may be substituted by a piece of material having a relatively high permeability, it may be a piece or insert made of iron, or made of an alloy such as a nickel iron alloy (for example SUPRA 50 or INVAR). It should be clear that a number of permanent magnets or respective metal inserts may be provided next to each other or may be distributed circumferentially around the diameter of the shuttle pin 120 or the connector body 110.

Figure 5:
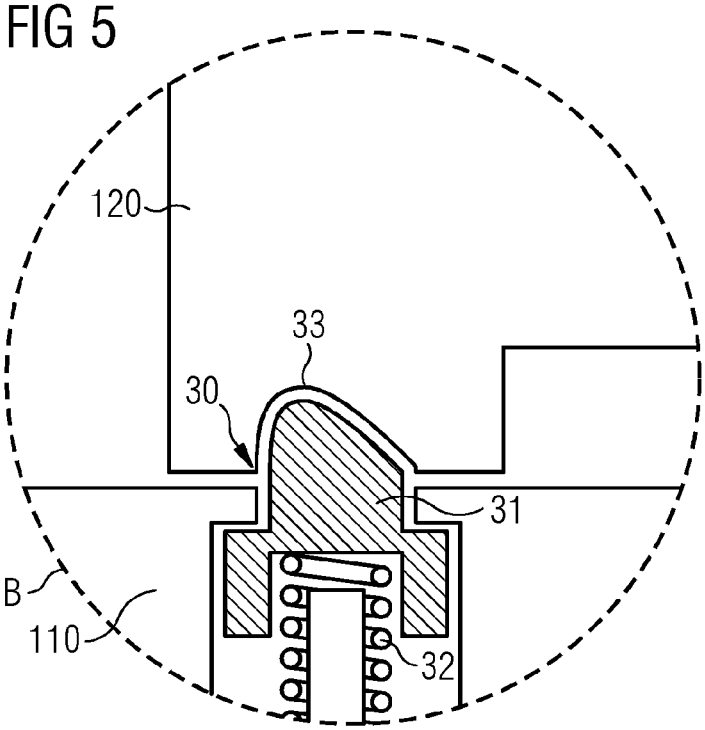
FIG. 5 is a schematic drawing showing a further implementation of a latching mechanism according to an embodiment.
Figure 7:
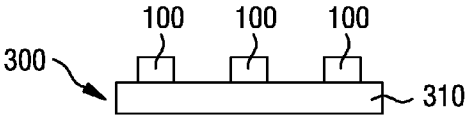
FIG. 7 is a schematic drawing showing a stab plate assembly wherein plural connector parts are mounted.

FIG. 5 illustrates a possible implementation of the second latching mechanism in form of a mechanical lathing mechanism 30. The mechanical latching mechanism 30 comprises a first latching element in form of the latch 31 that is retained in the connector body 110 (or at least in a structure that is supported against the connector body 110). The latch 31 protrudes radially inwardly into the chamber 115 and can be urged radially outwardly against the force of spring 32. In the shuttle pin 120, a respective second latching element in form of the recess 33 is provided that cooperates with the latch 31. In particular in the position illustrated in FIG. 3, the latch 31 is in engagement with the recess 33, thereby providing latching between the connector body 110 and the shuttle pin 120. For example by adjusting the slope of the faces of the latch 31, the force that is required to release the latching of the second latching mechanism can be adjusted.

For the magnetic latching mechanism 50, the releasing force may be adjusted by adjusting the number of permanent magnets, or by adjusting the strength of each permanent magnet.

The magnetic latching mechanism 50 or the mechanical latching mechanism 30 may also be used as retaining element 40, i.e. for latching the shuttle pin 120 to the connector body 110. In the embodiment of FIG. 2, the drawing of FIG. 5 shows an enlarged view of the area denoted with B, and the retaining element 40 is provided by the latching mechanism 30.

In some embodiments, the female connector part 100 may be a dummy plug and may thus comprise further components as compared to a simple protective cap. One such example is illustrated in FIG. 6. In the example of FIG. 6, the female connector part 100 furthermore comprises an insulating sleeve 130. The insulating sleeve 130 surrounds the pin 210 when the female and male connector parts 100, 200 are in the de-mated state. In the example of FIG. 6, the insulating sleeve 130 has a cup shape in which it surrounds the shuttle pin 120 on all sides except the side where it engages the pin 210. In the example of FIG. 6, the second latching mechanism 20 is provided in form of a magnetic latching mechanism 50. As can be seen, even when such insulating sleeve 130 is provided, magnetic latching between for example the first and second latching elements 21, 22 through the insulating sleeve 130 is possible.

The insulating sleeve 130 has on its inner side a metal coating 132 and on its outer side a metal coating 131. The metal coatings may for example be applied by metal plating. The outer coating 131 is preferably earthed so as to provide an earth screen around the pin 210. The inner coating 132 may be connected to the electrical contact 213 of the pin 210 by means of a contact element 135. Contact element 135 is just a simple element that provides an electrical connection between the inner coating 131 and the electrical contact 213, it is not a full socket contact that can be found on a fully functional female connector part (there is also no electrical connection provided by the female connector part 100). In the configuration of FIG. 6, the inner coating 132 is at the same potential as the electrical contact 213, so that no electrical stresses occur in the dielectric liquid that fills the space between the insulating sleeve 130 and the pin 210, and so that electrical stresses are confined to within the insulating sleeve 130.

In such configuration, it becomes possible to perform electrical testing of the male connector part 200. Such testing can be performed by applying respective voltages from the other side of the subsea cable 216.

In the example of FIG. 6, the retaining element 40 is provided in form of a mechanical latching mechanism 30. As illustrated, the mechanical latching mechanism 30 includes the latches 31 disposed in a forward portion of the connector body 110 inside the chamber 115 and the recesses 33, which can be provided in form of a circumferential groove in the shuttle pin 120. Upon disengagement of the male connector part 200, the latches 31 will be caught in the recesses 33 and thus prevent the shuttle pin 120 from being pulled out of the connector body 110, and will thus allow the first latching mechanism 10 to become released by the pulling force.

The second latching mechanism 20 is in the example of FIG. 6 implemented as a magnetic latching mechanism 50 as illustrated in FIG. 4. Accordingly, the first and second latching elements 21, 22 are provided in form of the permanent magnets 51, 52. As shown in the example of FIG. 6, both, a mechanical latching mechanism 30 and a magnetic latching mechanism 50, may be provided on the shuttle pin 120. It should be clear that in other configurations, the second latching mechanism 20 may also be a mechanical latching mechanism, or the retaining element 40 may also be provided by a magnetic latching mechanism. Accordingly, the latching element provided on the shuttle pin 120 may be used by both the second latching mechanism 20 and the retaining element 40 for the purpose of latching. As an example, instead of the latches 31, permanent magnets of high strength may be provided for latching with the second latching elements 22 of the second latching mechanism 20. A higher latching strength may thus be achieved to allow the release of the first latching mechanism 10 without the shuttle pin 120 being pulled out of the connector body 110. In another exemplary configuration, the recess 33 may be used for latching with a mechanical second latching mechanism 24, and with a mechanical latching mechanism provided for the retaining element 40. In even other configurations, the first latching elements 21 of the second latching mechanism 20 may be arranged to latch against the first and/or second latching elements 11, 12 of the first latching mechanism 10, e.g. magnetically.

As shown in FIG. 6, the female connector part 100 may furthermore comprise a locking mechanism 150 which is an external locking mechanism. The locking mechanism 150 can be engaged by a separate ROV operation after the female connector part 100 has been mated with the male connector part 200. In the schematic sketch of FIG. 6, only for the purpose of illustration, the locking mechanism 150 is illustrated as having arms with protrusions 151 that can be deflected to interact with respective protrusions 152 on the receptacle 201 of the male connector part 200 so as to lock the male connector part 200 in the mated position. As an example, a collar may be pushed over these arms to bring them into the lock position. In other configurations, the locking mechanism 150 may be for example comprise a plastic collar having plastic teeth that is pushed from the left hand side of FIG. 6 over the receptacle 201 of the male connector part 200, wherein the plastic teeth engage the outer surface of the receptacle 201 so as to hold the male connector part 200 in the mated condition. The configuration of the external locking mechanism 150 may be chosen in dependence on the particular application, for example in dependence on whether the receptacle 201 comprises any structure that can be used for latching, or whether the receptacle 201 does not comprise such structure and should not be modified (for which purpose the above mentioned plastic collar may for example be employed).

While specific embodiments are disclosed herein, various changes and modifications can be made without departing from the scope of the invention. The present embodiments are to be considered in all respects as illustrative and non-restrictive and all changes coming within the meaning and equivalency range of the appended claims are intended to be embraced therein.

The invention claimed is:

1. A connector part for use underwater or in a wet or severe environment, wherein the connector part is a female connector part configured for engagement with a male connector part having a pin, wherein the connector part comprises:

a connector body having a front portion with an opening for receiving the pin of the male connector part, a chamber inside the connector body, the chamber being filled with a dielectric liquid, and a shuttle pin configured to seal the opening in the front portion of the connector body when the connector part is in a demated state, wherein the shuttle pin is configured to be movable rearwardly into a rear portion of the connector body during mating of the connector part with the male connector part by interaction with said pin, wherein the connector part further comprises a first latching mechanism configured to latch the shuttle pin to the pin of the male connector part during mating, a second latching mechanism arranged in the rear portion of the connector body inside the chamber and configured to latch at least one of the shuttle pin or the pin to the connector body in a mated state of the connector part and the male connector part in order to hold the connector part and the male connector part in the mated state, and a retaining element configured to retain the shuttle pin in the connector body when the latching between the shuttle pin and the pin is released during de-mating of the connector part and the male connector part.

2. The connector part according to claim 1, wherein the latching of the first latching mechanism is releasable by a first releasing force, and wherein the latching of the second latching mechanism is releasable by a second releasing force, wherein the first releasing force is larger than the second releasing force.

3. The connector part according to claim 1, wherein the first latching mechanism is a magnetic latching mechanism that provides magnetic latching between the shuttle pin and the pin, or is a mechanical latching mechanism that provides mechanical latching between the shuttle pin and the pin.

4. The connector part according to claim 1, wherein the second latching mechanism is a magnetic latching mechanism that provides magnetic latching between connector body and the shuttle pin or pin, or is a mechanical latching mechanism that provides mechanical latching between connector body and the shuttle pin or pin.

5. The connector part according to claim 1, wherein the second latching mechanism comprises a first latching element that is mechanically supported against the connector body and a second latching element that is provided in or fixedly coupled to the shuttle pin.

6. The connector part according to claim 5, wherein the first latching element, the second latching element or both comprise a permanent magnet.

7. The connector part according to claim 5, further comprises an insulating sleeve, wherein in the mated state of the connector part when second latching mechanism is engaged, the insulating sleeve is at least partly located between the first latching element and the second latching element.

8. The connector part according to claim 7, wherein the insulating sleeve is cup-shaped and partly surrounds the shuttle pin in the mated state of the connector part.

9. The connector part according to claim 5, wherein the one of the first or second latching elements comprises a latch and the other of the first or second latching elements comprises a recess or groove.

10. The connector part according to claim 1, wherein the retaining element is provided by a third latching mechanism that is configured to provide latching between the connector body and the shuttle pin in the demated state of the connector part, or is provided by a protrusion on the shuttle pin that is caught on a retaining structure in the connector body so as to retain the shuttle pin in the connector body.

11. The connector part according to claim 1, further comprising a locking mechanism that is configured to be engaged at least after the connector part is mated to the male connector part and after engagement of the second latching mechanism, wherein the locking mechanism locks the connector part to the male connector part.

12. The connector part according to claim 11, wherein the locking mechanism is an external locking mechanism that has components that are exposed to seawater when the connector part is deployed subsea and the locking mechanism is in the locked state.

13. The connector part according to claim 1, wherein the connector part is a dummy plug or protective cap configured to be connected to the male connector part for providing protection for the male connector part when the male connector part is deployed subsea.

14. The connector part according to claim 1, wherein the connector part does not comprise an electrical or optical contact that is connected to a power line or data line, so that the mating of the connector part with the male connector part does not establish an electrical connection and does not establish a data connection.

15. A subsea stab plate assembly comprising:

at least one stab plate to which at least one connector part according to claim 1 is mounted.

16. The subsea stab plate assembly according to claim 15, wherein plural connector parts are mounted.

* * * * *